US008047309B2

(12) United States Patent
Overstreet et al.

(10) Patent No.: US 8,047,309 B2
(45) Date of Patent: Nov. 1, 2011

(54) PASSIVE AND ACTIVE UP-DRILL FEATURES ON FIXED CUTTER EARTH-BORING TOOLS AND RELATED SYSTEMS AND METHODS

(75) Inventors: James L. Overstreet, Tomball, TX (US); Robert J. Buske, The Woodlands, TX (US); Kenneth E. Gilmore, Cleveland, TX (US); John H. Stevens, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 168 days.

(21) Appl. No.: 12/133,988

(22) Filed: Jun. 5, 2008

(65) Prior Publication Data

US 2008/0251297 A1 Oct. 16, 2008

Related U.S. Application Data

(63) Continuation-in-part of application No. 11/685,898, filed on Mar. 14, 2007, now Pat. No. 7,677,338.

(51) Int. Cl.
*E21B 10/43* (2006.01)

(52) U.S. Cl. ..... 175/431; 175/57

(58) Field of Classification Search ..... 175/336, 175/401, 431
See application file for complete search history.

(56) References Cited

U.S. PATENT DOCUMENTS

| | | | | | |
|---|---|---|---|---|---|
| 387,448 | A | * | 8/1888 | Richards | 408/213 |
| 658,060 | A | * | 9/1900 | Dudley | 175/383 |
| 1,637,594 | A | * | 8/1927 | Stewart | 175/336 |
| 1,734,469 | A | * | 11/1929 | Journeay et al. | 175/401 |
| 1,805,087 | A | * | 5/1931 | Hamer | 175/342 |
| 1,816,568 | A | * | 7/1931 | Carlson | 175/336 |
| 1,899,728 | A | * | 2/1933 | Sandstone | 175/232 |
| 2,085,336 | A | * | 6/1937 | Sandstone | 175/104 |
| 2,204,657 | A | * | 6/1940 | Brendel | 175/342 |
| 2,218,130 | A | * | 10/1940 | Court | 15/104.12 |
| 2,234,454 | A | * | 3/1941 | Richter | 175/215 |
| 2,499,282 | A | * | 2/1950 | Roberts | 175/401 |
| 2,579,720 | A | * | 12/1951 | Atkinson | 175/323 |
| 3,043,385 | A | * | 7/1962 | Boyle | 175/401 |
| 3,628,616 | A | | 12/1971 | Neilson | |

(Continued)

FOREIGN PATENT DOCUMENTS

GB 2326894 1/1999

(Continued)

OTHER PUBLICATIONS

Merriam-Webster Dictionary, definition of "integral", accessed Jun. 21, 2010.*

(Continued)

*Primary Examiner* — William P Neuder
*Assistant Examiner* — Blake Michener
(74) *Attorney, Agent, or Firm* — TraskBritt

(57) ABSTRACT

Earth-boring tools include at least one up-drill feature disposed on a transition surface so as to be passive during down drilling and active during up drilling and/or back reaming operations. Systems for down drilling and up drilling with drill bits comprising one or more up-drill features are also disclosed. Furthermore, methods for forming a borehole with an earth-boring tool including such up-drill features and for forming an earth-boring tool comprising such up-drill features are also disclosed.

31 Claims, 5 Drawing Sheets

U.S. PATENT DOCUMENTS

| | | | | |
|---|---|---|---|---|
| 4,262,762 | A * | 4/1981 | Potratz | 175/401 |
| 4,512,425 | A * | 4/1985 | Brock | 175/430 |
| 4,591,008 | A | 5/1986 | Oliver | |
| 4,986,375 | A * | 1/1991 | Maher | 175/323 |
| 5,074,367 | A | 12/1991 | Estes | |
| 5,289,889 | A | 3/1994 | Gearhart et al. | |
| 5,415,243 | A * | 5/1995 | Lyon et al. | 175/331 |
| 5,492,186 | A | 2/1996 | Overstreet et al. | |
| 5,494,123 | A | 2/1996 | Nguyen | |
| 6,116,357 | A * | 9/2000 | Wagoner et al. | 175/228 |
| 6,173,797 | B1 * | 1/2001 | Dykstra et al. | 175/374 |
| 6,206,110 | B1 * | 3/2001 | Slaughter et al. | 175/57 |
| 6,446,739 | B1 * | 9/2002 | Richman et al. | 175/331 |
| 6,729,418 | B2 * | 5/2004 | Cariveau et al. | 175/53 |
| 6,772,849 | B2 | 8/2004 | Oldham et al. | |
| 7,137,460 | B2 * | 11/2006 | Slaughter et al. | 175/53 |
| 2006/0021800 | A1 | 2/2006 | Beuershausen et al. | |
| 2007/0102198 | A1 | 5/2007 | Oxford et al. | |
| 2007/0102199 | A1 | 5/2007 | Smith et al. | |
| 2008/0223619 | A1 | 9/2008 | Overstreet et al. | |
| 2009/0294178 | A1 * | 12/2009 | Radford | 175/57 |
| 2009/0308663 | A1 * | 12/2009 | Patel et al. | 175/374 |

FOREIGN PATENT DOCUMENTS

| | | |
|---|---|---|
| WO | 2006099629 | 9/2006 |

OTHER PUBLICATIONS

International Search Report for International Application No. PCT/US2009/046110 dated Jan. 8, 2010, 3 pages.

Written Opinion of the International Searching Authority for International Application No. PCT/US2009/046110 dated Jan. 8, 2010, 4 pages.

* cited by examiner

PASSIVE AND ACTIVE UP-DRILL FEATURES ON FIXED CUTTER EARTH-BORING TOOLS AND RELATED SYSTEMS AND METHODS

CROSS-REFERENCE TO RELATED APPLICATIONS

The present application is a continuation-in-part of U.S. patent application Ser. No. 11/685,898, filed Mar. 14, 2007, now U.S. Pat. 7,677,338,issued Mar. 16, 2010, the disclosure of which application is incorporated herein by reference in its entirety.

TECHNICAL FIELD

Embodiments of the present invention relate generally to earth-boring tools and, more particularly, to earth-boring tools comprising passive and active up-drill protective and cutting features.

BACKGROUND

Drilling wells for oil and gas production conventionally employ longitudinally extending sections, or so-called "strings," of drill pipe to which, at one end, is secured a drill bit of a larger diameter. The drill bit conventionally forms a bore hole through the subterranean earth formation to a selected depth. Generally, after a selected portion of the bore hole has been drilled, the drill bit is removed from the bore hole so that a string of tubular members of lesser diameter than the bore hole, known as casing, can be placed in the bore hole and secured therein with cement. Therefore, drilling and casing according to the conventional process typically requires sequentially drilling the bore hole using drill string with the drill bit attached thereto, removing the drill string and drill bit from the bore hole, and disposing and cementing a casing into the bore hole.

Rotary drill bits are commonly used for drilling such bore holes or wells. One type of rotary drill bit is the fixed-cutter bit (often referred to as a "drag" bit), which typically includes a plurality of cutting elements secured to a face region of a bit body. Referring to FIG. 1, a conventional fixed-cutter rotary drill bit 100 includes a bit body 110 having a face 120 defining a proximal end and comprising generally radially extending blades 130, forming fluid courses 140 therebetween extending to junk slots 150 between circumferentially adjacent blades 130. Bit body 110 may comprise a composite matrix or a steel body, both as known in the art.

The drill bit includes an outer diameter 155 defining the radius of the wall surface of a bore hole. The outer diameter 155 may be defined by a plurality of gage regions 160, which may also be characterized as "gage pads" in the art. Gage regions 160 comprise longitudinally upward (as the drill bit 100 is oriented during use) extensions of blades 130. The gage regions 160 may have wear-resistant inserts and/or coatings, such as hardfacing material, tungsten carbide inserts natural or synthetic diamonds, or a combination thereof, on radially outer surfaces 165 thereof as known in the art to inhibit excessive wear thereto so that the design borehole diameter to be drilled by the drill bit is maintained over time.

A plurality of cutting elements 180 is conventionally positioned on each of the blades 130. Generally, the cutting elements 180 have either a disk shape or, in some instances, a more elongated, substantially cylindrical shape. The cutting elements 180 commonly comprise a "table" of super-abrasive material, such as mutually bound particles of polycrystalline diamond, formed on a supporting substrate of a hard material, conventionally cemented tungsten carbide. Such cutting elements are often referred to as "polycrystalline diamond compact" (PDC) cutting elements or cutters. The plurality of PDC cutting elements 180 may be provided within cutting element pockets 190 formed in rotationally leading surfaces of each of the blades 130. Conventionally, a bonding material such as an adhesive or, more typically, a braze alloy may be used to secure the cutting elements 180 to the bit body 110.

The bit body 110 of a rotary drill bit 100 typically is secured to a steel shank 200 having an American Petroleum Institute (API) threaded connection for attaching the drill bit 100 to a drill string (not shown). Top transition surfaces 210 are located at the upper ends of the gage regions 160 between the outer diameter defined by the radially outer surfaces 165 of gage regions 160 and a shank shoulder 220. Transition edges 230 are defined between the radially outer surfaces 165 of gage regions 160 and their respective, associated top transition surfaces 210.

During drilling operations, the drill bit 100 is positioned at the bottom of a well bore hole and rotated. Drilling fluid is pumped through the inside of the bit body 110, and out through nozzles (not shown). As the drill bit 100 is rotated, the PDC cutting elements 180 scrape across and shear away the underlying earth formation material. The formation cuttings mix with the drilling fluid and pass through the fluid courses 140 and then through the junk slots 150, up through an annular space between the wall of the bore hole and the outer surface of the drill string to the surface of the earth formation.

When drilling in unconsolidated, highly abrasive and/or hardened formations as well as in other formation materials, the radially outer surface of the gage regions 160 of the drill bits are subjected to wear caused by the abrasive cuttings being drilled, the high sand content in the mud, and the sand particles along the borehole wall. Improvements in the wear-resistant inserts and/or coatings have helped to limit the accelerated wear from occurring to the radially outer surfaces 165 of the gage regions 160 in the normal (i.e., downward) drilling mode. However, when the drill bit 100 is reversed in the bore hole, such as when back reaming or up drilling is performed, substantial wear to the top transition surfaces 210 including the transition edges 230 located near the shank 200 end of the bit may occur. Such wear causes rounding over the gage region 160 and eventually will significantly wear the gage region 160.

BRIEF SUMMARY

Various embodiments of the present invention are directed toward a fixed-cutter drilling tool configured for down drilling and up drilling through subterranean formation and for limiting the accelerated wear from occurring to the passive regions. In one embodiment, the present invention comprises a body comprising an outer diameter and secured to a shank. At least one transition surface may be associated with and positioned between the outer diameter of the body and the lower extent of the shank. At least one up-drill feature may be disposed on the at least one transition surface and may be positioned to be passive (not engage the formation being drilled) during down drilling and active during up drilling, back reaming, or other similar activities.

In another embodiment, the present invention contemplates a system for both down drilling and up drilling with a fixed-cutter drill bit. The system may comprise a bit body comprising a face that defines a distal end. At least one blade may be disposed over a portion of the face and may, at a proximal end thereof, define a gage region. At least one top transition surface may extend from a radially outer surface at a proximal end of the gage region toward a distal end of a shank secured to the bit body, and at least one up-drill feature may be disposed on the at least one top transition surface. The system may comprise a down drilling mode in which, while down drilling, the at least one top transition surface is configured as passive and portions of the bit body distal to the at least one top transition surface are configured as active. Furthermore, the system may comprise an up-drilling mode in which, during up drilling or back reaming, the at least one top transition surface is configured as active.

In yet another embodiment, the present invention comprises a method of forming a bore hole. The method may comprise down drilling through a formation with an earth-boring tool. The earth-boring tool may comprise a body comprising a face at a distal end thereof and a gage region near a proximal end thereof, the gage region comprising longitudinally upward extensions of a plurality of blades. At least one top transition surface may extend from a proximal end of the gage region toward a distal end of the bit shank. Furthermore, at least one up-drill feature may be disposed on the at least one top transition surface, the at least one up-drill feature being passive during the down drilling. The method may further comprise up drilling in the bore hole with the earth-boring tool, wherein the at least one up-drill feature engages and cuts through some of the formation.

In another embodiment, the present invention contemplates a method of forming a fixed-cutter drilling tool. The method may comprise forming a body comprising an active region and a passive region in a down drilling mode. The active region may comprise portions of the body distal to a transition edge while the passive region may comprise portions of the body proximal to the transition edge. The body may be configured so that the passive region is active when the body is in an up-drilling mode. The method further comprises disposing at least one up-drill feature on the passive region.

DETAILED DESCRIPTION

The illustrations presented herein are, in some instances, not actual views of any particular up-drill features or drill bit, but are merely idealized representations which are employed to describe the present invention. Additionally, elements common between figures may retain the same numerical designation.

Figure 1:
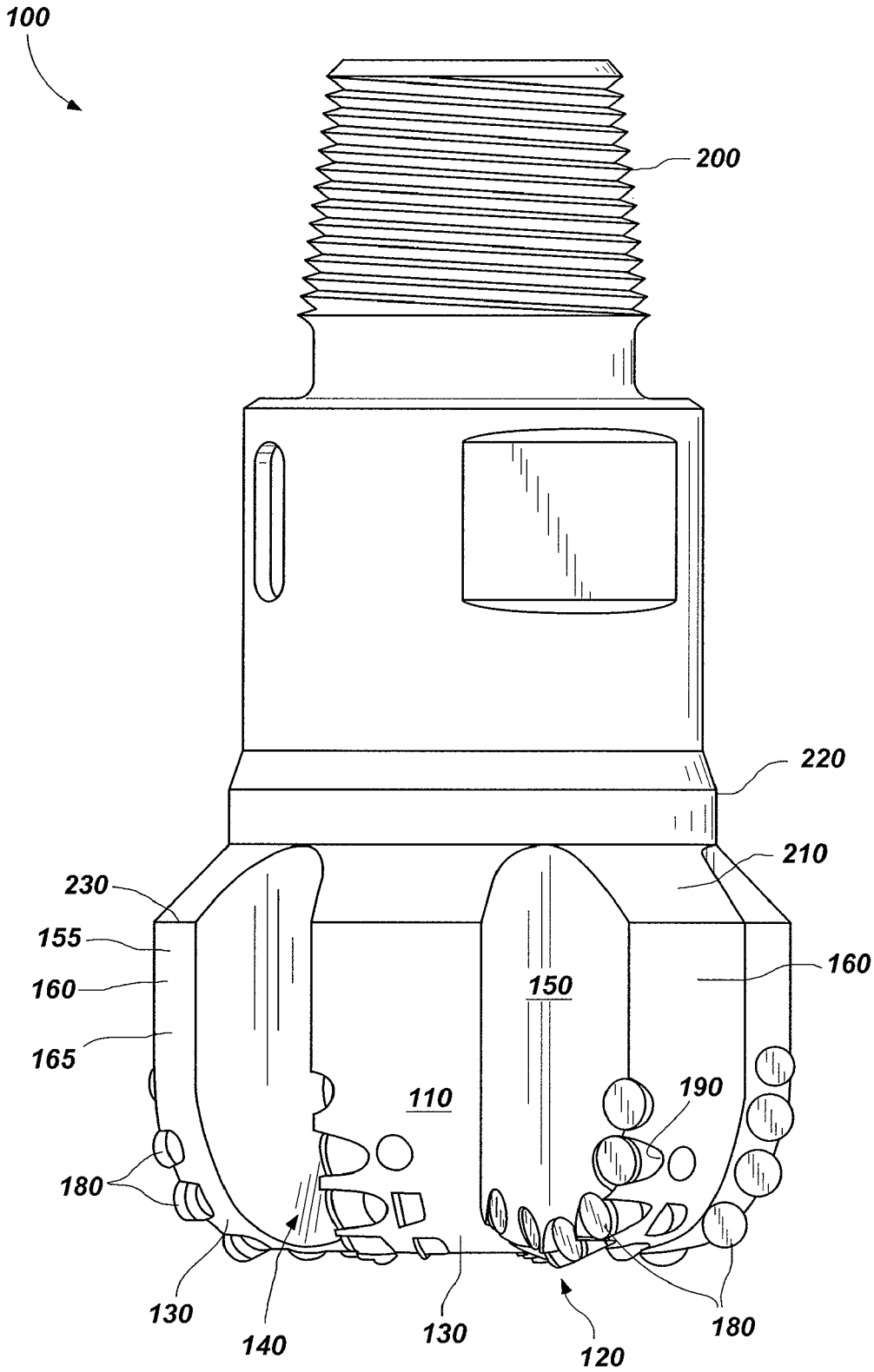
FIG. 1 Prior Art
FIG. 1 illustrates an elevation view of a conventional fixed-cutter earth-boring rotary drill bit.
Figure 2:
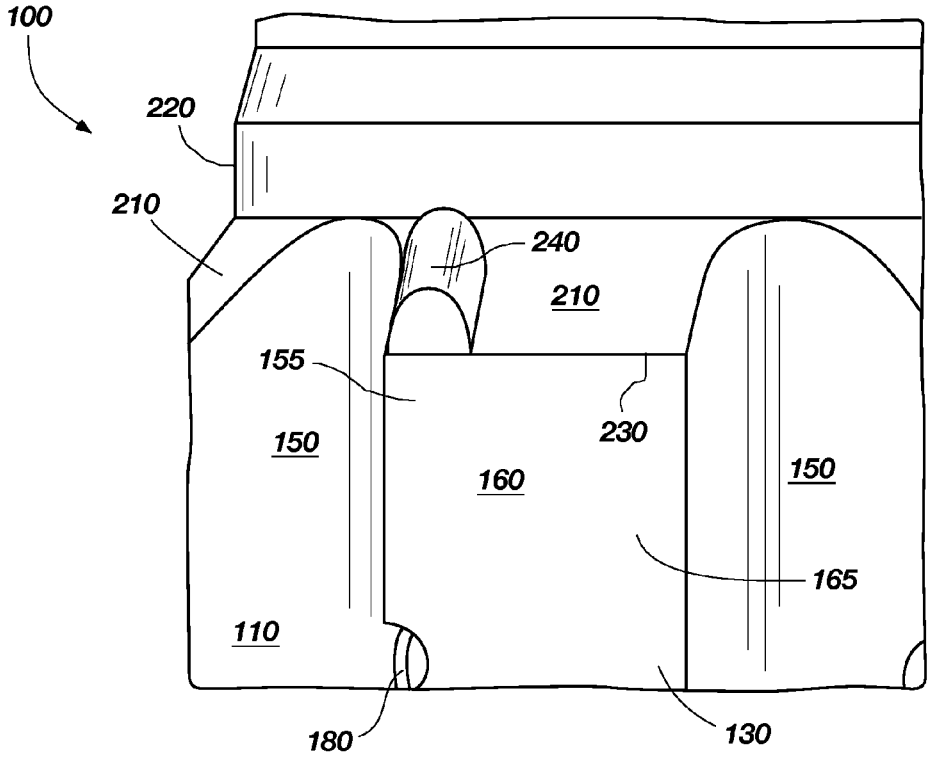
FIG. 2 is an enlarged elevation view of an earth-boring drill bit including an up-drill feature positioned on a top transition surface according to an embodiment of the invention.

Embodiments of the present invention provide an earth-boring tool comprising features capable of providing wear protection and/or cutting formation material during up drilling, back reaming, and other similar procedures. Referring to FIG. 2, an enlarged view of a top transition surface 210 of an earth-boring drill bit is shown. The drill bit of FIG. 2 may be a fixed-cutter rotary drill bit similar to the drill bit 100 of FIG. 1. As described above with reference to FIG. 1, the earth-boring drill bit 100 includes a bit body 110 comprising one or more top transition surfaces 210 located between the outer diameter 155 and the shank shoulder 220. In some embodiments, the top transition surface 210 may comprise a chamfer, e.g., the surface may lie at an oblique angle to the longitudinal axis of the earth-boring drill bit 100. The earth-boring drill bit 100 may further comprise a face 120 at a distal end thereof having one or more blades 130 extending generally radially therefrom and continuing to extend generally longitudinally upward along the bit body 110 to form a gage region 160 near a proximal end thereof. The radially outer surface 165 of gage region 160 may define the outer diameter 155 such that the top transition surface 210 may be associated with the proximal end of the gage region 160. The top transition surface 210 may extend from the proximal end of the gage region 160, defined by the transition edges 230, toward the shank 200 and may, optionally, extend to a distal end of the shank shoulder 220.

The drill bit 100 may be operated in a conventional down-drilling mode wherein regions or portions of the bit body that are distal to (i.e., below, in vertical drilling) the top transition surfaces 210, and more particularly, to the transition edges 230, are defined as "active" and may engage as well as cut formation material during down drilling and wherein regions or portions of the bit body 110 that are proximal to (i.e., above) the gage region 160, and more particularly, the transition edges 230, and radially inboard of the outermost radius defined by the gage region 160 are defined as "passive" (i.e., does not intentionally engage the formation or cut formation material) during down drilling. The drill bit 100 also may be operated in an up-drilling mode, wherein the regions or portions of the bit body 110 that are proximal to the gage region 160, and which are passive during down drilling, are active during up drilling or back reaming. Accordingly, the portions that are active during down drilling typically become passive during up drilling.

Figure 3:
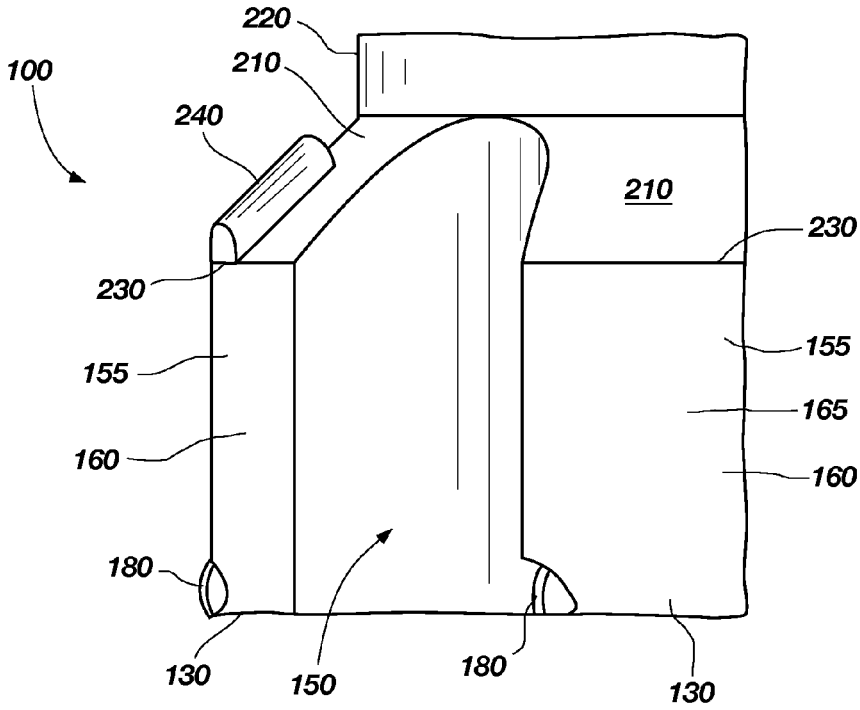
FIG. 3 is an enlarged partial side view of the drill bit of FIG. 2.

The drill bit 100 also comprises an up-drill feature 240 strategically located on the passive portions of the bit body 110. In some embodiments, the up-drill feature 240 may comprise metallurgically bonded hardfacing or a carbide material and may be similar to those features of U.S. application Ser. No. 11/685,898, referred to herein above and described therein as "hardfacing," such as hardfacing 61, 71, 81, 91, 101, 111, and/or 121. The up-drill feature 240 is configured for cutting formation material and providing wear protection for the bit body 110 during up drilling or back reaming. Accordingly, the up-drill feature 240 is disposed on portions of the bit body 110 generally located axially above the transition edges 230, and radially inward of the maximum outer diameter of the drill bit 100 (e.g., at the gage region 160). As illustrated in FIGS. 2 and 3, the up-drill feature 240 may be located on the top transition surfaces 210, extending from a position adjacent to the transition edge 230 toward the shank shoulder 220, the radially outermost edge of the up-drill feature 240 being, in some embodiments, at least substantially flush with the gage region 160. In some embodiments, the up-drill feature 240 extends the entire length from the transition edge 230 to the shank shoulder 220, while in other embodiments the up-drill feature 240 extends only a portion of the length between the transition edge 230 and the shank shoulder 220.

The up-drill feature 240 may comprise hardfacing material having a thickness of about 0.10 inch or more, as measured from the transition surface 210 itself. In another embodiment, the hardfacing material may comprise a thickness of 0.25 inches or more. The hardfacing material itself may comprise iron or nickel-based materials. By way of example and not limitation, the hardfacing material may include a matrix of Ni—Cr—B—Si with spherical cast WC pellets, and/or spherical sintered WC pellets. Another non-limiting example may include an iron matrix, again with spherical WC pellets, spherical cast WC pellets, crushed sintered WC, and/or crushed cast WC granules or any combination thereof. The hardfacing may be applied using a welding process. Such processes for application of the hardfacing to oil field tools are generally known to those of ordinary skill in the art and may include oxy-acetylene, MIG, TIG, SMA, SCA, PTA, etc. Furthermore, welding may include employing a pulsed arc as well as a constant arc. In some embodiments, the hardfacing may be mechanically shaped, such as by machining, after it is applied to form specific features and/or configurations in the hardfacing material.

In other embodiments, the up-drill features 240 may be preformed from another suitable material, such as, for example carbides or borides of one or more of W, Ti, Mo, Nb, V, Hf, Ta, Cr, Zr, Al, or Si, diamond (natural or synthetic), and diamond impregnated material. In such embodiments, the preformed up-drill feature 240 may comprise similar thicknesses as the hardfacing material. The up-drill feature 240 comprising one or more of these other suitable materials may be attached to the passive portion of the bit body 110. For example, the up-drill feature 240 may be brazed, welded or otherwise secured to the bit body. In some embodiments, the up-drill feature 240 may further be at least substantially covered in a hardfacing material. Such a configuration may be beneficial to form specific features into the up-drill features 240, such as those described in more detail below. For example, a specific feature may be formed by molding or otherwise performing the up-drill feature 240 and then hardfacing material may be disposed over the preformed up-drill feature 240 in such a manner so as to at least substantially retain those external features formed in the preformed up-drill feature 240.

Figure 4:
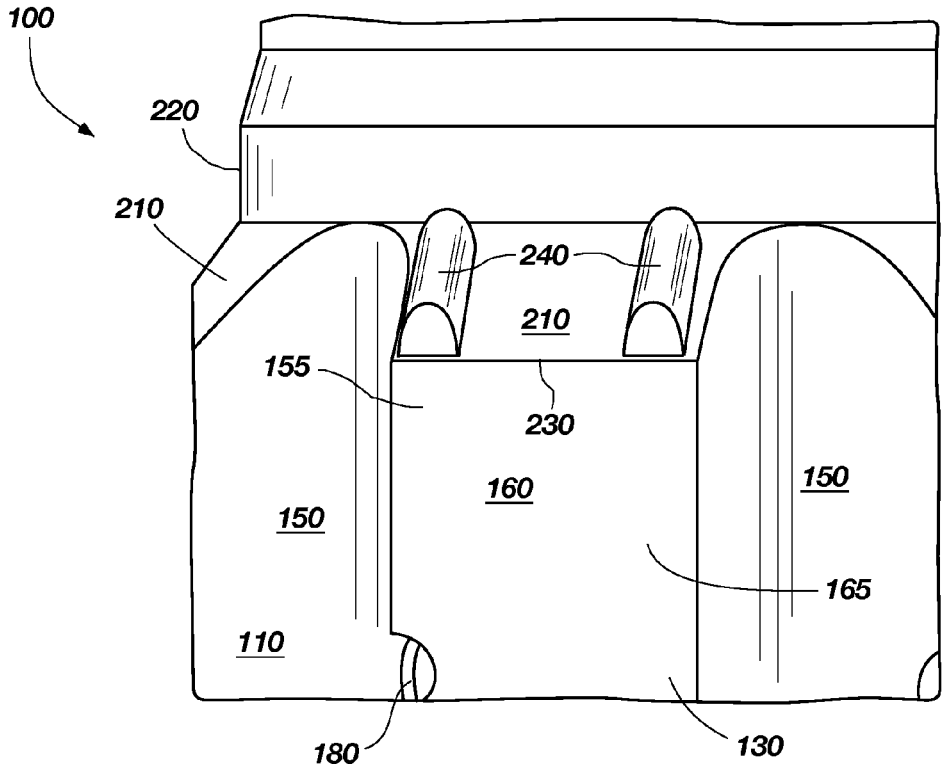
FIG. 4 is an enlarged elevation view illustrating a plurality of up-drill features on a top transition surface of an earth-boring drill bit according to an embodiment of the invention.

In some embodiments, the drill bit 100 may comprise a plurality of up-drill features 240 on portions of the bit body 110. FIG. 4 illustrates an embodiment of a drill bit 100 comprising a plurality of up-drill features 240 on the top transition surface 210. In this embodiment, the plurality of up-drill features 240 may be at least substantially similar in thickness and shape and may also extend across the top transition surface 210 in at least substantially the same manner. The drill bit 100 may include a sufficient number of up-drill features 240 to cover at least substantially all of the top transition surfaces 210, while in other embodiments a single up-drill feature 240 may be configured to cover at least substantially the entire top transition surface 210. In the embodiments shown in FIG. 4, the plurality of up-drill features 240 are positioned rotationally adjacent to one another. Alternatively, or in addition, a plurality of up-drill features 240 may be positioned adjacent one another in the direction from the transition edges 230 to the shank shoulder 220.

Figure 5:
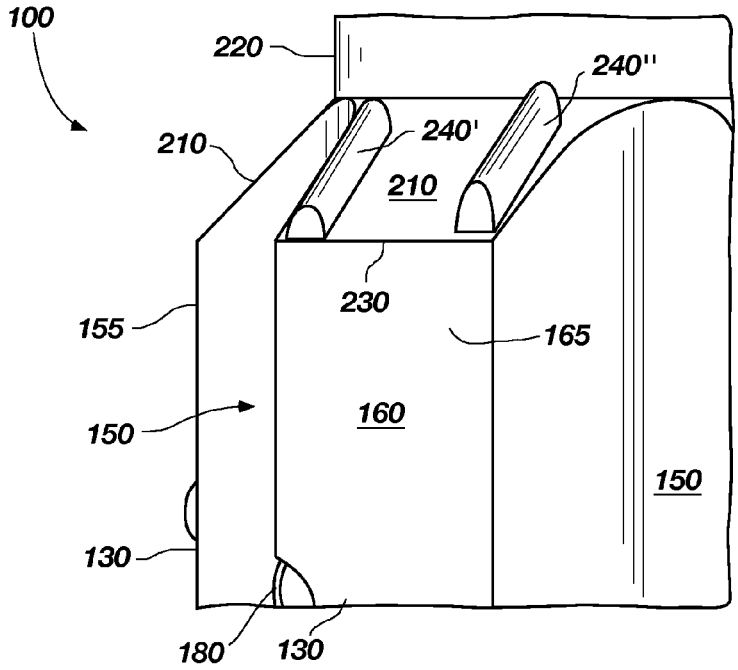
FIG. 5 illustrates a magnified elevation view of a blade and top transition surface including a plurality of up-drill features comprising differing general thicknesses according to an embodiment of the invention.

In other embodiments, the plurality of up-drill features 240 may comprise differing thicknesses and/or differing shapes. As shown in FIG. 5, a first up-drill feature 240' may have a general thickness which differs from the thickness of a second up-drill feature 240". As used herein, the term "thickness" of an up-drill feature generally indicates its distance above a portion of the drill bit to which it is disposed, for example the distance above the top transition surface.

Figure 6:
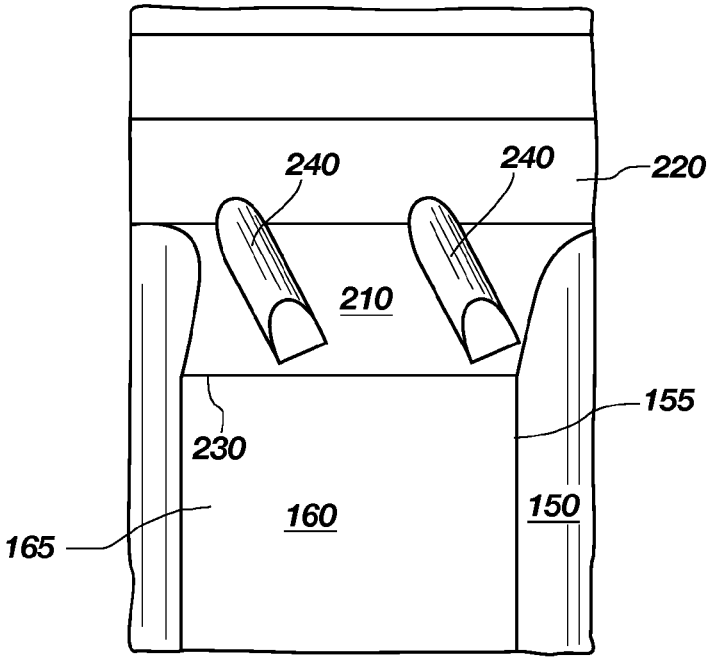
FIGS. 6 and 7 show a plurality of up-drill features extending diagonally across the top transition surface.
Figure 7:
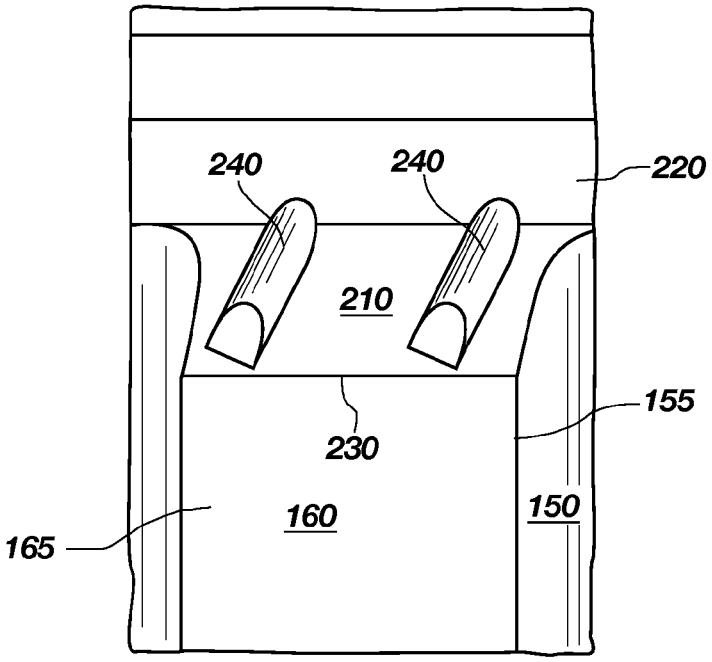

In some embodiments, the one or more up-drill features 240 may be disposed over the top transition surfaces 210 extending diagonally from the transition edge 230 toward the shank shoulder 220. FIG. 6 shows an embodiment in which the one or more up-drill features 240 extend diagonally to the left across the top transition surfaces 210. FIG. 7 shows an embodiment in which the one or more up-drill features 240 extend diagonally to the right across the top transition surface 210.

Figure 8:
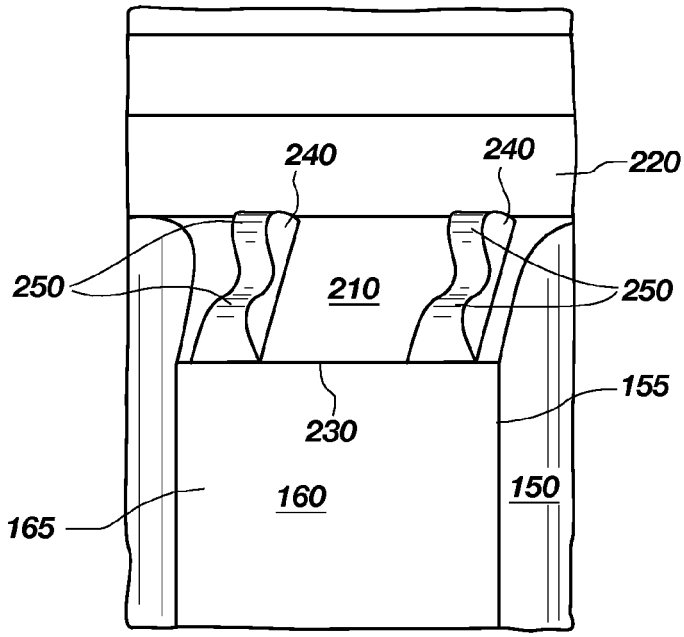
FIG. 8 illustrates an embodiment in which one or more of the up-drill features comprises at least one tooth-like protrusion therein.

The one or more up-drill features 240 may include one or more specific features configured according to the specific application of the drill bit 100. In some embodiments, the one or more specific features may be formed by applying the hardfacing in such a manner as to form a desired shape and/or contour. In other embodiments, the one or more specific features may be formed by machining the desired shape and/or contour into the hardfacing comprising the one or more up-drill features 240. In still other embodiments, when the up-drill features 240 comprise a carbide material, the one or more specific features may be formed by machining or molding the carbide. By way of example and not limitation, in one embodiment shown in FIG. 8, the one or more up-drill features 240 may be configured to include at least one feature configured as a tooth-like protrusion 250 therein. The tooth-like protrusion 250 may be further configured to comprise a back rake, side rake, or chamfer in accordance with the specific application. Such tooth-like protrusions 250 may be combined with any of the above described embodiments. For example, in embodiments comprising more than one up-drill feature 240, at least one up-drill feature 240 may comprise at least one tooth-like protrusion 250 while at least one other up-drill feature 240 may not include any tooth-like protrusion 250.

Still other designs for the up-drill feature 240 include additionally strategic up-drill feature placement and configurations, graded composite hardfacing materials, various carbide materials, recesses or cavities at edges of the outer diameter, and various methods of applying the material also may be employed. Moreover, material may be removed from portions of the bit body to form cavities. In one embodiment, the cavities may be backfilled with hardfacing and comprise additional hardfacing extending out of the cavities above an original surface of the bit body to form up-drill features. In other embodiments, a carbide up-drill feature 240 may be attached, e.g., brazed, to the bit body within the cavities.

Figure 9:
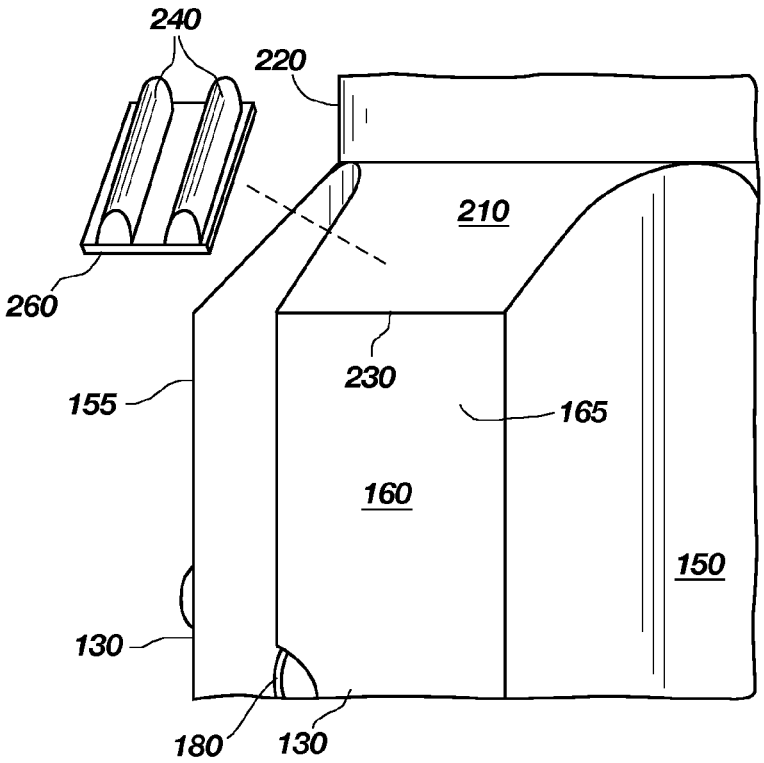
FIG. 9 illustrates an up-drill feature pad comprising at least one up-drill feature and positionable on a passive portion of the bit body.

FIG. 9 illustrates another embodiment of the present invention comprising an attachment pad 260 comprising at least one up-drill feature 240 formed thereon. The attachment pad 260 is configured to be positioned on a portion of the bit body 110. For example, the attachment pad 260 may be sized and configured to be positioned on at least a portion of a top transition surface 210. In some embodiments, the attachment pad 260 may comprise a pad to which one or more up-drill features 240 are secured. The attachment pad 260 may comprise a material such as, for example, metal or metal alloy, carbides or borides of one or more of W, Ti, Mo, Nb, V, Hf, Ta, Cr, Zr, Al, or Si, diamond (natural or synthetic), and diamond impregnated material. The at least one up-drill feature 240 may comprise any of those materials described herein above with relation to embodiments of the up-drill features 240. In the case of a preformed up-drill feature 240, such as those described herein above, the one or more up-drill features 240 may be secured to the attachment pad 260 by employing those methods known to those of ordinary skill in the art. In other embodiments, the attachment pad 260 and the one or more up-drill features 240 may comprise an integral structure. In such embodiments, the pad 260 and the one or more up-drill features 240 may comprise a material similar to those materials described above with relation to the preformed up-drill features 240, such as carbide, boride, diamond (natural or synthetic), diamond impregnated material or other suitable material or combinations thereof. By way of example and not limitation, the one or more up-drill features 240 and attachment pad 260 may be formed by molding the up-drill features 240 with the desired shape and the attachment pad 260 as an integral structure. The attachment pad 260 may be brazed, welded or otherwise secured to the passive portion of the bit body 110, such methods being generally known to those of ordinary skill in the art.

Earth-boring tools according to embodiments of the present invention may be employed to form a bore hole in a subterranean formation. An earth-boring tool may be connected to a drill string and may down drill through subterranean formation to form a bore hole therein. The earth-boring tool may be configured according to any of the embodiments described herein above, and includes at least one up-drill feature 240 positioned on a portion of the earth-boring tool. The earth-boring tool may further be used to up drill in the bore hole. As the earth-boring tool up drills in the bore hole, the at least one up-drill feature 240 is configured and positioned as active and directly engages and cuts through some of the formation. As used herein, the term "earth boring tool" includes and encompasses conventional fixed cutter bits including core bits, bicenter bits, eccentric bits, fixed cutter reamers such as, for example, so-called "reamer wings," and other drilling tools having a suitable surface or surfaces for disposition of an up-drill feature of an embodiment of the invention thereon.

The present invention has utility in relation to fixed-cutter drill bits and other drilling tools having bodies at least substantially comprised of a metal or metal alloy such as steel, but also has utility in bits and tools having bodies at least substantially comprised of particle-matrix composite materials, including conventional infiltrated composite bodies as well as non-infiltrated composite bodies. Conventional infiltrated composite bodies include those in which hard particles (e.g., tungsten carbide) are infiltrated by a molten liquid metal matrix material (e.g., a copper-based alloy) within a mold. Non-infiltrated composite bodies may include, for example, "sintered" particle matrix bits in which a powder metal (e.g., nickel or cobalt powder) is mixed with a powder comprising hard particles (e.g., tungsten carbide) and, thereafter, pressed and sintered to a final density. An example of sintered particle matrix bodies include those disclosed in pending U.S. patent application Ser. No. 11/271,153, filed Nov. 10, 2005 and now U.S. Pat. No. 7,802,495, issued Sep. 9, 2010, U.S. patent application Ser. No. 11/272,439, also filed Nov. 10, 2005, now U.S. Pat. No. 7,776,256, issued Aug. 17, 2010, the disclosure of each of which application is incorporated herein in its entirety by this reference.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. An earth-boring tool, comprising:

a body comprising a face at a distal end thereof and gage regions defining an outer diameter and comprising longitudinally upward extensions of a plurality of blades having a plurality of cutting elements fixedly attached thereto at the face and a shank secured to the body;

at least one transition surface comprising a chamfer positioned between the outer diameter at an uppermost end of an associated gage region and the shank; and a plurality of up-drill features comprising elongated structures disposed on and attached to the at least one transition surface and extending from a position adjacent to a transition edge between the at least one transition surface and the associated gage region, the plurality of up-drill features positioned to be passive during down drilling and positioned and structured to actively engage and cut formation material during up drilling or back reaming, wherein a radially outermost surface of the at least one up-drill feature is flush with the outer diameter of the body and wherein a radially outermost edge of the at least one up-drill feature is flush with the transition edge, at least one up-drill feature of the plurality of up-drill features comprising at least one of a different thickness and a different shape from at least another up-drill feature of the plurality of up-drill features before being deployed in a borehole.

2. The earth-boring tool of claim 1, wherein at least one up-drill feature of the plurality of up-drill features comprises a material comprising at least one of hardfacing, carbide, boride, diamond, and diamond impregnated materials.

3. The earth-boring tool of claim 1, wherein the body is comprised of at least one material selected from the group consisting of a metal, a metal alloy, an infiltrated particle-matrix composite, and a non-infiltrated particle-matrix composite.

4. The earth-boring tool of claim 1, wherein at least one up-drill feature of the plurality of up-drill features extends an entire length of the at least one transition surface.

5. The earth-boring tool of claim 1, wherein at least one up-drill feature of the plurality of up-drill features comprises a thickness of about 0.10 inch or more.

6. The earth-boring tool of claim 1, wherein at least two up-drill features of the plurality of up-drill features are disposed on a single transition surface of the at least one transition surface.

7. The earth-boring tool of claim 6, wherein each of the at least two up-drill features is positioned adjacent another of the at least two up-drill features in at least one of a rotational direction of the earth-boring tool and in a direction from a proximal end of the at least one transition surface toward a distal end of the at least one transition surface.

8. The earth-boring tool of claim 1, wherein at least one up-drill feature of the plurality of up-drill features extends diagonally across the at least one transition surface.

9. The earth-boring tool of claim 1, wherein at least one up-drill feature of the plurality of up-drill features comprises at least one tooth-like protrusion.

10. The earth-boring tool of claim 1, further comprising an attachment pad secured to and extending along the at least one transition surface, wherein at least some up-drill features of the plurality of up-drill features are disposed on the attachment pad.

11. The earth-boring tool of claim 10, wherein the attachment pad is comprised of a material comprising at least one of a metal, metal alloy, carbide, boride, diamond, and diamond impregnated materials.

12. A system for both down drilling and up drilling with a fixed-cutter drill bit, comprising:

a body comprising:

a face that defines a distal end of the body, at least one blade disposed over a portion of the face;

at least one gage region defining an outer diameter of the body, the at least one gage region comprising an extension of at least one blade extending substantially parallel to a longitudinal axis of the body; and at least one top transition surface extending from the at least one gage region toward a shank and a plurality of up-drill features, each up-drill feature comprising an elongated structure disposed on the at least one top transition surface and extending from a position adjacent to a transition edge between the at least one transition surface and the at least one gage region, at least one up-drill feature of the plurality of up-drill features having at least one of differing thickness and differing shape from at least another up-drill feature of the plurality of up-drill features before engaging an earth formation;

the body being operable in a down drilling mode wherein portions of the bit body distal to the at least one top transition surface are positioned and structured to engage and cut formation material during down drilling; and the body being operable in an up-drilling mode wherein the at least one top transition surface is positioned and structured to engage and cut formation material during up drilling or back reaming.

13. The system of claim 12, wherein at least one up-drill feature of the plurality of up-drill features comprises a material comprising at least one of hardfacing, carbide, boride, diamond, and diamond impregnated materials.

14. The system of claim 12, wherein the body is comprised of at least one of a metal, a metal alloy, an infiltrated particle-matrix composite, and a non-infiltrated particle-matrix composite.

15. The system of claim 12, wherein at least one up-drill feature of the plurality of up-drill features comprises a thickness of about 0.10 inch or more.

16. The system of claim 12, wherein the plurality of up-drill features are positioned at least one of rotationally adjacent to each other and adjacent in a direction from the proximal end of the gage region toward the distal end of the shank.

17. The system of claim 12, wherein at least one up-drill feature of the plurality of up-drill features extends diagonally across the at least one transition surface.

18. The system of claim 12, wherein at least one up-drill feature of the plurality of up-drill features comprises at least one tooth-like protrusion.

19. The system of claim 12, further comprising an attachment pad secured to and extending along the at least one top transition surface, at least one up-drill feature of the plurality of up-drill features being disposed on the attachment pad.

20. A method of forming a fixed-cutter drilling tool, comprising:

forming a body comprising an active region and a passive region in a down drilling mode, the active region comprising portions of the body distal to a transition edge located at an intersection of a radially outermost surface of the body and at least one top transition surface extending from the transition edge toward a shank at an oblique angle to a longitudinal axis of the body and the passive region comprising the at least one top transition surface, wherein the passive region is active in an up-drilling mode;

disposing a plurality of up-drill features on the passive region by disposing the plurality of up-drill features on an attachment pad or forming the plurality of up-drill features integrally with an attachment pad;

configuring at least two up-drill features of the plurality of up-drill features on the attachment pad with at least one of differing thicknesses and differing shapes from one another before being deployed in a borehole;

positioning the attachment pad to extend across at least a portion of the passive region; and securing the attachment pad to an outer surface of the body.

21. The method of claim 20, wherein disposing the plurality of up-drill features on the passive region comprises disposing the plurality of up-drill features on the attachment pad such that at least one up-drill feature of the plurality of up-drill features extends an entire length of the at least one top transition surface.

22. The method of claim 20, wherein disposing the plurality of up-drill features on the passive region comprises disposing the plurality of up-drill features on the attachment pad such that the at least one up-drill feature of the plurality of up-drill features extends diagonally across the at least one top transition surface.

23. The method of claim 20, wherein disposing the plurality of up-drill features on the passive region further comprises forming at least one up-drill feature of the plurality of up-drill features from a material comprising at least one of hardfacing, carbide, boride, diamond, and diamond impregnated materials.

24. The method of claim 20, wherein disposing the plurality of up-drill features on the passive region comprises disposing the plurality of up-drill features on the attachment pad such that a radially outermost edge of at least one up-drill feature of the plurality of up-drill features is at least substantially flush with the transition edge.

25. The method of claim 20, wherein disposing the plurality of up-drill features on the passive region comprises disposing at least one up-drill feature of the plurality of up-drill features on the attachment pad by welding or brazing.

26. The method of claim 20, wherein disposing the plurality of up-drill features on the passive region comprises disposing at least one up-drill feature of the plurality of up-drill features on the attachment pad with a thickness of at least substantially 0.10 inch or more.

27. The method of claim 20, further comprising forming at least one tooth-like protrusion in at least one up-drill feature of the plurality of up-drill features.

28. The method of claim 27, wherein forming at least one tooth-like protrusion comprises at least one of disposing the at least one up-drill feature on the attachment pad in such a manner as to form at least one tooth-like protrusion, machining a portion of the at least one up-drill feature into the shape of the at least one tooth-like protrusion, and molding the at least one up-drill feature to comprise the shape of the at least one tooth-like protrusion.

29. The method of claim 20, wherein disposing the plurality of up-drill features on an attachment pad comprises disposing at least one up-drill feature of the plurality of up-drill features on the attachment pad comprised of a material comprising at least one of metal, metal alloy, carbide, boride, diamond, and diamond impregnated materials.

30. The method of claim 20, wherein disposing the plurality of up-drill features on the passive region comprises:

forming the plurality of up-drill features integrally with the attachment pad; and securing the plurality of up-drill features and integral attachment pad to the passive region.

31. The method of claim 20, further comprising disposing at least one up-drill feature of the plurality of up-drill features within at least a portion of at least one cavity formed in the attachment pad such that the at least one up-drill feature extends out of the at least one cavity above an original surface of the attachment pad.

* * * * *

UNITED STATES PATENT AND TRADEMARK OFFICE

CERTIFICATE OF CORRECTION

PATENT NO. : 8,047,309 B2
APPLICATION NO. : 12/133988
DATED : November 1, 2011
INVENTOR(S) : Overstreet et al.

It is certified that error appears in the above-identified patent and that said Letters Patent is hereby corrected as shown below:

On the title page:

ITEM [56]

U.S. PATENT DOCUMENTS

| | | |
|---|---|---|
| Page 2, COLUMN 1, | LINE 14, | change "Slaughter et al." to --Slaughter, Jr. et al.-- |
| Page 2, COLUMN 1, | LINE 16, | change "Cariveau et al." to --Slaughter, Jr. et al.-- |

In the specification:

| | | |
|---|---|---|
| COLUMN 1, | LINE 10, | change "7,677,338,issued" to --7,677,338, issued-- |
| COLUMN 7, | LINE 54, | change "in pending" to --in-- |

In the claims:

| | | |
|---|---|---|
| CLAIM 12, COLUMN 9, | LINE 20, | change "transition surface" to --top transition surface-- |
| CLAIM 17, COLUMN 9, | LINE 52, | change "transition surface." to --top transition surface.-- |

Signed and Sealed this
Eleventh Day of March, 2014

Michelle K. Lee

Michelle K. Lee
*Deputy Director of the United States Patent and Trademark Office*